US010027005B2

(12) United States Patent
Torpey et al.

(10) Patent No.: US 10,027,005 B2
(45) Date of Patent: Jul. 17, 2018

(54) VOLTAGE CONTROLLED TUNABLE FILTER

(71) Applicants: Matthew S. Torpey, Ellicott City, MD (US); Benjamin Andrew Copley, Linthicum, MD (US); Jeffrey David Hartman, Severn, MD (US); Wayne Stephen Miller, Hanover, MD (US)

(72) Inventors: Matthew S. Torpey, Ellicott City, MD (US); Benjamin Andrew Copley, Linthicum, MD (US); Jeffrey David Hartman, Severn, MD (US); Wayne Stephen Miller, Hanover, MD (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 148 days.

(21) Appl. No.: 15/010,987

(22) Filed: Jan. 29, 2016

(65) Prior Publication Data

US 2017/0222292 A1 Aug. 3, 2017

(51) Int. Cl.
*H01P 1/20* (2006.01)
*H01P 3/02* (2006.01)
(Continued)

(52) U.S. Cl.
CPC ..... *H01P 1/2002* (2013.01); *H01P 1/2088* (2013.01); *H01P 3/02* (2013.01); *H01P 11/006* (2013.01); *H01P 11/007* (2013.01)

(58) Field of Classification Search
CPC ..... H01P 1/2002; H01P 1/2084; H01P 3/02; H01P 1/2088; H01P 11/006; H01P 11/007
(Continued)

(56) References Cited

U.S. PATENT DOCUMENTS 5,459,123 A 10/1995 Das
6,985,050 B2 1/2006 Sengupta et al.
(Continued)

OTHER PUBLICATIONS

Joel D Barrera et al: "Analysis of a Variable SIW Resonator Enabled by Dielectric Material Perturbations and Applications", IEEE Transactions on Microwave Theory and Techniques, IEEE Service Center, Piscataway, NJ, US, vol. 61, No. I, Jan. 1, 2013 (Jan. 1, 2013), pp. 225-233, XP0I1488059, ISSN: 0018-9480, DOI: 10.1109/TMTT.2012.2226052 * Fig. 3 and B. Variable SIW Resonator at pp. 226, 227 *.

(Continued)

*Primary Examiner* — Rakesh Patel
(74) *Attorney, Agent, or Firm* — Tarolli, Sundheim, Covell & Tummino LLP

(57) ABSTRACT

An apparatus includes a top conductive layer of on an integrated circuit waveguide filter and a bottom conductive layer. The top and bottom conductive layers are coupled via a plurality of couplers that form an outline of the waveguide filter. A dielectric substrate layer is disposed between the top conductive layer and the bottom conductive layer of the integrated circuit waveguide filter. The dielectric substrate layer has a relative permittivity, εr that affects the tuning of the integrated circuit waveguide filter. At least one tunable via includes a tunable material disposed within the dielectric substrate layer and is coupled to a set of electrodes. The set of electrodes enable a voltage to be applied to the tunable material within the tunable via to change the relative permittivity of the dielectric substrate layer and to enable tuning the frequency characteristics of the integrated circuit waveguide filter.

20 Claims, 7 Drawing Sheets

(51) Int. Cl.
*H01P 11/00* (2006.01)
*H01P 1/208* (2006.01)

(58) Field of Classification Search
USPC ..... 333/208, 209, 239
See application file for complete search history.

(56) References Cited

U.S. PATENT DOCUMENTS

| | | | | |
|---|---|---|---|---|
| 8,508,319 | B1 | 8/2013 | Newsham et al. | |
| 2004/0046623 | A1 | 3/2004 | Brown et al. | |
| 2006/0006966 | A1 | 1/2006 | Kang et al. | |
| 2007/0287634 | A1 | 12/2007 | Lin et al. | |
| 2009/0243762 | A1* | 10/2009 | Chen | H01P 1/2088 333/212 |
| 2016/0164155 | A1* | 6/2016 | Wang | H01P 1/182 333/161 |

OTHER PUBLICATIONS

Park J et al: "Low-loss, tunable 5 microwave capacitors using bismuth zinc niobate thin films", Applications of Ferroelectrics, 2004. ISAF-04. 2004 14th IEEE International Symposium on Montreal, Canada Aug. 23-27, 2004, Piscataway, NJ, USA,IEEE, Aug. 23, 2004 (Aug. 23, 2004), pp. 17-20, XP010784487, DOI: 10.1109/ISAF.2004.1418327 ISBN: 978-0-7803-8410-1 * abstract; figure 1 *.

European Search Report for corresponding EP 17 15 1950, dated Jun. 27, 2017.

* cited by examiner

VOLTAGE CONTROLLED TUNABLE FILTER

TECHNICAL FIELD

This disclosure relates to filter circuits, and more particularly to an integrated circuit waveguide that employs a tunable material to provide a tunable filter circuit.

BACKGROUND

A waveguide filter is an electronic filter that is constructed with waveguide technology. Waveguides are typically hollow metal tubes inside which an electromagnetic wave may be transmitted. Filters are devices used to allow signals at some frequencies to pass (e.g., the passband), while others are rejected (e.g., the stopband). Filters are a basic component of electronic engineering circuits and have numerous applications. These include selection of signals and reduction of noise. Waveguide filters are most useful in the microwave band of frequencies, where they are a convenient size and have low loss. Examples of microwave filter use are found in satellite communications, telephone networks, and television broadcasting, for example. When employed as filters, air cavity waveguide filters have the ability to handle high power and low loss at a fixed frequency. To serve systems with multiple channels, several cavity filters are integrated with switches into a switched filter bank. With the addition of each channel however, the size increases, the cost increases and performance is lowered. These are three of the key performance distracters to air cavity waveguides. Another conventional waveguide filter is a Hititte tunable filter formed as a monolithic microwave integrated circuit (MMIC). This is a single MMIC with multiple tunable filter channels. While compact, these filters have very poor insertion loss (e.g., −30 to −8 dB) making them unusable for most filter bank applications.

SUMMARY

This disclosure relates an integrated circuit waveguide that employs a tunable material to provide a tunable filter circuit. In one aspect, an apparatus includes a top conductive layer of on an integrated circuit waveguide filter. The apparatus includes a bottom conductive layer of the integrated circuit waveguide filter. The top and bottom conductive layers are coupled via a plurality of couplers that form an outline of the waveguide filter. A dielectric substrate layer is disposed between the top conductive layer and the bottom conductive layer of the integrated circuit waveguide filter. The dielectric substrate layer has a relative permittivity, εr that affects the tuning of the integrated circuit waveguide filter. At least one tunable via comprising a tunable material is disposed within the dielectric substrate layer and is coupled to a set of electrodes. The set of electrodes enable a voltage to be applied to the tunable material within the tunable via to change the relative permittivity of the dielectric substrate layer and to enable tuning the frequency characteristics of the integrated circuit waveguide filter.

In another aspect, a circuit includes at least two segments of an integrated circuit waveguide filter. The segments coupled by an iris. Each segment of the integrated circuit waveguide filter includes a top conductive layer for the respective segment of the integrated circuit waveguide filter and a bottom conductive layer for the respective segment of the integrated circuit waveguide filter. The top and bottom conductive layers of the respective segment are coupled via a plurality of couplers that form an outline of the waveguide filter for the respective segment. A dielectric substrate layer is disposed between the top conductive layer and the bottom conductive layer of the respective segment of the integrated circuit waveguide filter. The dielectric substrate layer for the respective segment has a relative permittivity, εr that affects the tuning of the integrated circuit waveguide filter. At least one substrate tunable via includes a tunable material disposed within the dielectric substrate layer for the respective segment and is coupled to a set of electrodes. The set of electrodes enable a voltage to be applied to the tunable material within the tunable via to change the relative permittivity of the dielectric substrate layer for the respective segment and to enable tuning the frequency characteristics of the integrated circuit waveguide filter for the respective segment. At least one iris tunable via includes a tunable material disposed within the iris coupling the respective segments and is coupled to a set of electrodes. The set of electrodes enable a voltage to be applied to the tunable material within the tunable via of the iris to change the relative permittivity of the iris and to enable tuning the frequency characteristics of the integrated circuit waveguide filter.

In yet another aspect, a method includes forming a dielectric substrate layer of an integrated circuit waveguide filter. The dielectric substrate layer has a relative permittivity, εr that affects the tuning of the integrated circuit waveguide filter. The method includes forming a top conductive layer on the dielectric substrate layer of the integrated circuit waveguide filter. This includes forming a bottom conductive layer on the dielectric substrate layer of the integrated circuit waveguide filter. The method includes depositing a plurality of couplers in the dielectric substrate layer to connect the top conductive layer and the bottom conductive layer. The plurality of couplers form an outline of the waveguide filter. The method includes forming at least one tunable area comprising a tunable material within the dielectric substrate layer. The tunable area is coupled to a set of electrodes. The set of electrodes enable a voltage to be applied to the tunable material within the tunable area to change the relative permittivity of the dielectric substrate layer and to enable tuning the frequency characteristics of the integrated circuit waveguide filter.

DETAILED DESCRIPTION

This disclosure relates an integrated circuit waveguide that employs a tunable material to provide a tunable filter circuit. A substrate integrated waveguide (SIW) filter can be provided where a tunable material such as Barium (Ba) Strontium (Sr) Titanate ($TiO_3$) (BST) (or other materials) can be embedded in a dielectric substrate layer of the waveguide (e.g., Silicon dielectric layer). The dielectric constant of the tunable material is changed by applying voltage, changing the effective dielectric constant of a dielectric loaded waveguide filter, thereby tuning the filter frequency. The tunable filter described herein can include an iris-connected SIW filter configuration that includes multiple filter segments, for example. This type of filter typically has three layers within each segment: a solid, bottom conductive plane; a solid, top conductive plane; and a middle dielectric plane having a dielectric constant insensitive to voltage. An iris can be disposed between cavities of the dielectric loaded waveguide filter, made by either cutting or etching out from the substrate or using vias to create an outline of the filter. Tuning capability is achieved by adding via holes into the dielectric filled cavities of the filter. These vias are then processed to add the tunable material such as BST. The top conductive plane can be fabricated such that voltage can be provided from a voltage source to each of the tunable material filled vias.

When voltage is applied to the vias (or areas), the dielectric constant of the tunable material changes, which in turn changes the dielectric constant of the dielectric loaded waveguide filter, thereby achieving a tunable filter. By fabricating the vias throughout the filter cavities (or a single larger via in the cavity), the range of tuning can be increased. Further, by tuning the cavity vias and/or iris vias separately, the user can control the filters position in frequency as well as bandwidth. The resulting tunable filter is more compact, less expensive, and higher performance than a conventional switched filter bank that is tunable during operation. By eliminating switches and the need for multiple filters, a more selective and robust system is achieved.

Figure 1A:
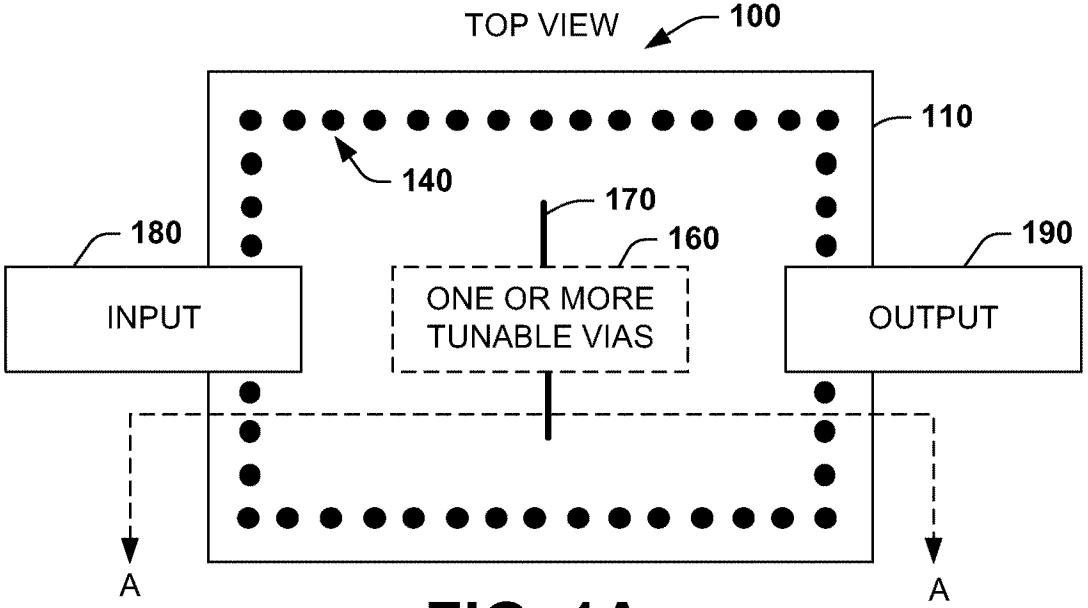
FIG. 1A illustrates a top view of an example of an integrated circuit waveguide apparatus that employs a tunable material to provide a tunable filter.
Figure 1B:
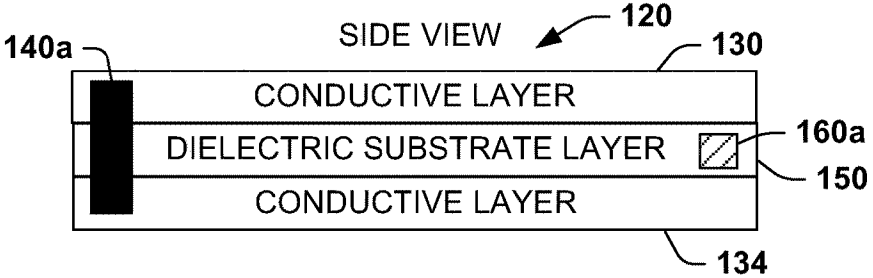
FIG. 1B illustrates a side view of an example of an integrated circuit waveguide apparatus that employs a tunable material to provide a tunable filter.

FIG. 1A illustrates a top view 100 of an example integrated circuit waveguide apparatus 110 that employs a tunable material to provide a tunable filter. FIG. 1B illustrates a side view 120 of the apparatus 110 along the line A-A of the top view 100. As shown in the side view 120, the apparatus 110 includes a top conductive layer 130 for the integrated circuit waveguide filter. A bottom conductive layer 134 is on the other side of the integrated circuit waveguide filter. The top and bottom conductive layers 130 and 134 are coupled via a plurality of couplers (shown at reference numeral 140 of the top view and 140*a* of the bottom view) that form an outline of the waveguide filter. The couplers 140 can be conductive material such as copper or gold, for example, and can be configured to provide different waveguide filtering characteristics as is described below.

A dielectric substrate layer 150 is disposed between the top conductive layer 130 and the bottom conductive layer 134 of the integrated circuit waveguide filter. The dielectric substrate layer 150 has a relative permittivity, εr that affects the tuning of the integrated circuit waveguide filter. At least one tunable via (reference numeral 160 for top view and 160*a* for side view) is provided and includes a tunable material that is disposed within the dielectric substrate layer 150 and is coupled to a set of electrodes 170. The set of electrodes 170 enable a voltage to be applied to the tunable material within the tunable via 160/160*a* to change the relative permittivity of the dielectric substrate layer 150 and to enable tuning the frequency characteristics of the integrated circuit waveguide filter. As shown, the apparatus 110 can include an input node 180 to receive an input signal and output node 190 to provide a filtered output signal such as a filter microwave signal, for example.

As will be illustrated and described below with respect to FIG. 2, the apparatus 110 can represent a single segment of a set of interconnected segments that collectively operate as a set of waveguides providing a collective filtering operation where each segment can be connected by a tunable iris segment. Various waveguide configurations can be provided that also employs the tunable materials described herein. These include Substrate Integrated Waveguides (SIW), Ridged Waveguides (RWG), Iris waveguides, Iris-Coupled waveguides, Post waveguides, Post-wall waveguides, Dual- or Multi-Mode waveguides, Evanescent Mode waveguides, Corrugated waveguides, Waffle-Iron waveguides, Absorptive waveguides, Rectangular waveguides, and Circular waveguides, for example.

The tunable vias 160/160*a* can be provided as a single via that substantially fills the cavity of the dielectric substrate layer 150 in one example. In another example, the tunable vias 160/160*a* can be formed throughout the dielectric layer 150 (and or iris section as described below). When multiple vias 160/160*a* are employed, separate electrodes 170 would be attached to each of the separate vias respectively to enable tuning throughout the dielectric substrate layer 150. In one example, the tunable material can include BaSrTiO3 (BST) where, Ba is Barium, Sr is Strontium, and TiO3 is Titanate comprising Titanium and Oxygen.

The BST is a piezoelectric material which allows for tuning described herein when a voltage is applied to the material. The BST has stable thermal properties in that it returns baseline properties (e.g., substantially no hysteresis) after heating or cooling above/below ambient temperatures. Other tunable materials can also be utilized where chemical formulas as altered to facilitate hysteresis stability. For example, the tunable material in the vias 160/160*a* can include $Ba_xCa_{1-x}TiO_3$, where Ca is Calcium and x is varied in a range from about 0.2 to about 0.8 to facilitate hysteresis stability of the tunable material.

In another example, the tunable material in the vias 160/160*a* can include $Pb_xZr_{1-x}TiO_3$, where Pb is Lead, Zr is Zirconium, and x is varied in a range from about 0.05 to about 0.4 to facilitate hysteresis stability of the tunable material. In yet another example, the tunable material can include $(Bi_{3x},Zn_{2-3x})(Zn_xNb_{2-x})$ (BZN), where Bi is Bismuth, Zn is Zinc, Nb is Niobium, and x is ½ or ⅔ to facilitate hysteresis stability of the tunable material. In still yet other examples, the tunable material can be selected from at least one of $PbLaZrTiO_3$, $PbTiO_3$, $BaCaZrTiO_3$, $NaNO_3$, $KNbO_3$, $LiNbO_3$, $LiTaTiO_3$, $PbNb_2O_6$, $PbTa_2O_6$, $KSr(NbO_3)$, $NaBa_2(NbO_3)_5$, $KH_2PO_4$, where La is Lanthanum, Na is sodium, N is Nitrogen, K is potassium, Li is lithium, Ta is tantalum, H is Hydrogen, and P is Phosphorus.

In some cases, metal oxides can be utilized as part of the tunable materials. The metal oxides in the tunable materials can be selected from at least one of Mg, Ca, Sr, Ba, Be, Ra, Li, Na, K, Rb, Cs, Fr, Ti, V, Cr, Mn, Zr, Nb, Mo, Hf, Ta, and W, where Mg is Magnesium, Be is Beryllium, Ra is Radium, Rb is Rubidium, Cs is Cesium, Fr is Francium, V is Vanadium, Cr is Chromium, Mn is Manganese, Mo is Molybdenum, Hf is Hafnium, and W is Tungsten. In another example, the tunable material includes metal oxides selected from at least one of Al, Si, Sn, Pb, Bi, Sc, Y, La, Ce, Pr, and Nd, where Al is Aluminum, Si is Silicon, Sn is Tin, Sc is Scandium, Y is Yttrium, Ce is Cerium, Pr is Praseodymium, and Nd is Neodymium. In other examples, the tunable material includes metal oxides selected from at least one of $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$, and $La_2O_3$. As will be illustrated and described below with respect to FIGS. 3 through 3B, the plurality of couplers 140/140*a* can be conductive vias that are configured as a low pass filter waveguide, a high pass filter waveguide, a band pass filter waveguide, or a band reject filter waveguide, for example. Also, the plurality of couplers 140/140*a* can be configured to provide waveform shaping that includes at least one of a monotonic filter, an elliptic filter, and a hybrid filter, for example.

Figure 2:
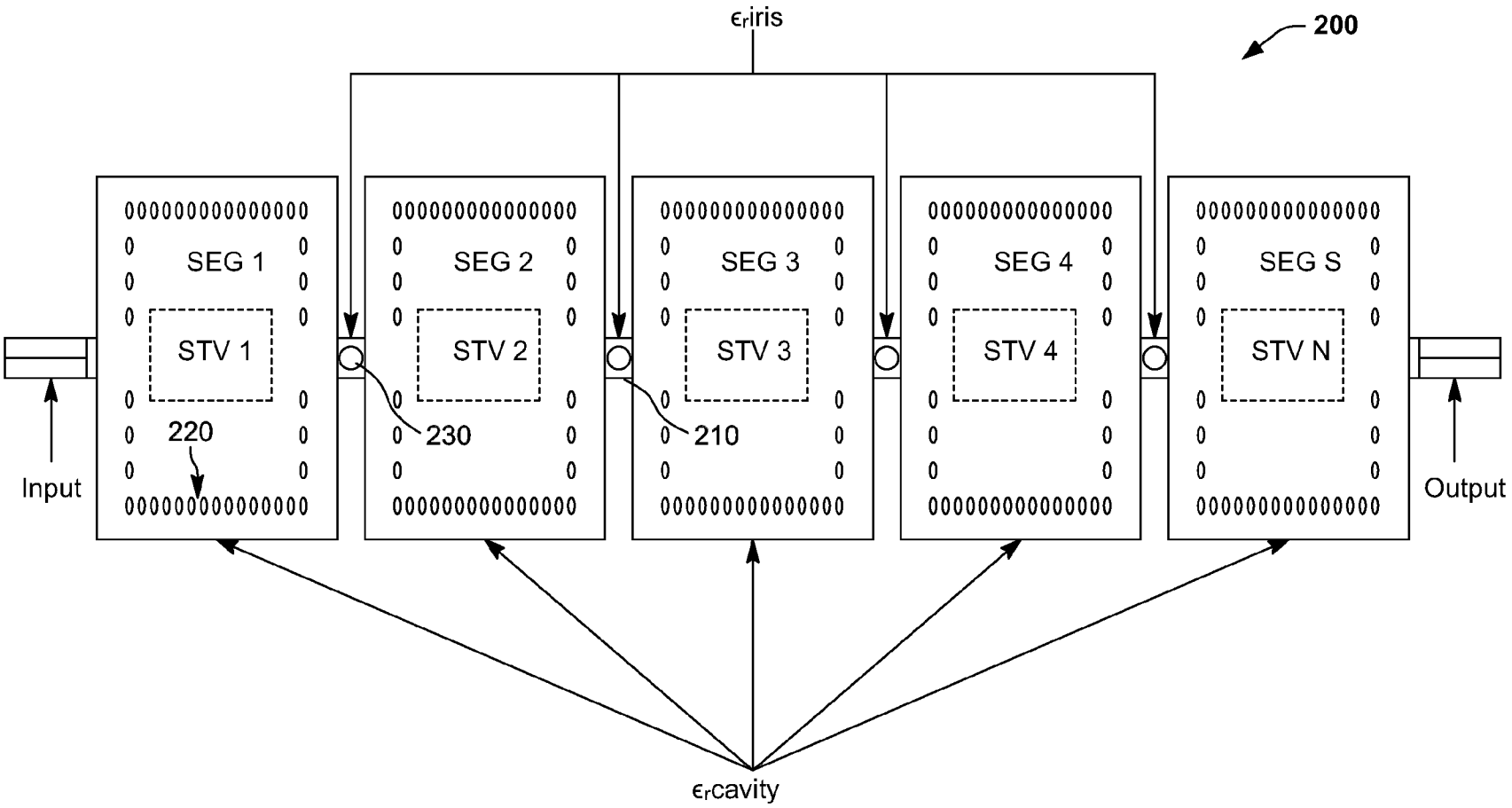
FIG. 2 illustrates an example of a segmented integrated circuit waveguide circuit that employs a tunable material within and/or between respective segments to provide a tunable filter circuit.

FIG. 2 illustrates an example of a segmented integrated circuit waveguide circuit 200 that employs a tunable material within and/or between respective segments to provide a tunable filter circuit. The circuit 200 includes at least two segments of an integrated circuit waveguide filter where the segments are shown as SEG 1 through SEG S, with S being a positive integer. The segments are coupled by an iris, where one example iris is shown at 210. Each segment of the integrated circuit waveguide filter includes a top conductive layer for the respective segment of the integrated circuit waveguide filter and a bottom conductive layer for the respective segment of the integrated circuit waveguide filter. For purposes of brevity, a side view is not shown illustrating the inner layers of each segment however each segment can be configured as illustrated with respect to FIG. 1B.

The top and bottom conductive layers of the respective segment are coupled via a plurality of couplers that form an outline of the waveguide filter for the respective segment. One example set of couplers for a respective segment is shown at 220. A dielectric substrate layer is disposed between the top conductive layer and the bottom conductive layer of the respective segment of the integrated circuit waveguide filter. The dielectric substrate layer for the respective segment has a relative permittivity, $\varepsilon r$ that affects the tuning of the integrated circuit waveguide filter. At least one substrate tunable via includes a tunable material disposed within the dielectric substrate layer for the respective segment and is coupled to a set of electrodes. The substrate tunable vias are shown as STV1 through STVN, with N being a positive integer. As noted previously, a single tunable via can be provided per segment which substantially fills the dielectric material. In another example, each segment can have tunable vias disposed throughout the respective segment. In another example, a tunable area (e.g., shape such as a rectangle that is larger than a via) can be provided within the iris and/or waveguide segment.

The set of electrodes for the tunable via in each segment enable a voltage to be applied to the tunable material within the tunable via to change the relative permittivity of the dielectric substrate layer for the respective segment and to enable tuning the frequency characteristics of the integrated circuit waveguide filter for the respective segment. In this example, at least one iris tunable via can be provided between segments that includes a tunable material disposed within the iris coupling the respective segments and is coupled, connected, and/or attached to a set of electrodes. An example iris tunable via is shown as 230. The set of electrodes for the iris tunable via enable a voltage to be applied to the tunable material within the tunable via of the iris to change the relative permittivity of the iris and to enable tuning the frequency characteristics of the integrated circuit waveguide filter. In some cases, either iris tuning or cavity tuning may be applied. In other examples, both iris tuning and cavity tuning can be applied to adjust the frequency characteristics of the integrated circuit waveguide filter.

Figure 3A:
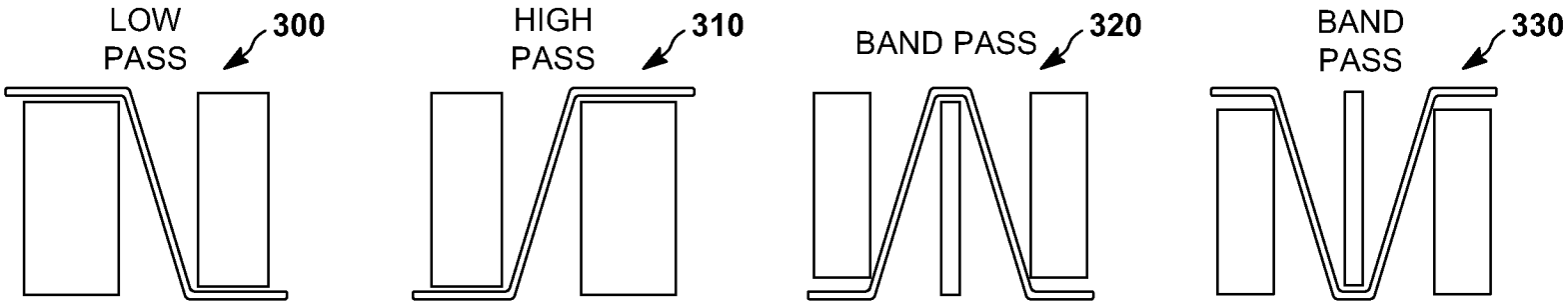
FIG. 3A illustrates an example of filter types that can be configured for an integrated circuit waveguide that employs a tunable material to provide a tunable filter.

FIG. 3A illustrates an example of filter types that can be configured for an integrated circuit waveguide that employs a tunable material to provide a tunable filter. As noted previously, the filter types can be configured by how the couplers between the top and bottom layers are placed within a given segment of the waveguide. In one example, a low pass filter 300 can be configured where low frequencies are passed and higher frequencies are rejected. In another example, a high pass filter 310 can be configured where high frequencies are passed and lower frequencies are rejected by the waveguide. In yet another example, a band pass filter 330 can be configured where a range of selected frequencies within a given band of frequencies are passed and frequencies outside the band are rejected. In still yet another example, a band reject filter 330 can be configured where selected frequencies within a given band are rejected and frequencies outside the given band are passed.

Figure 3B:
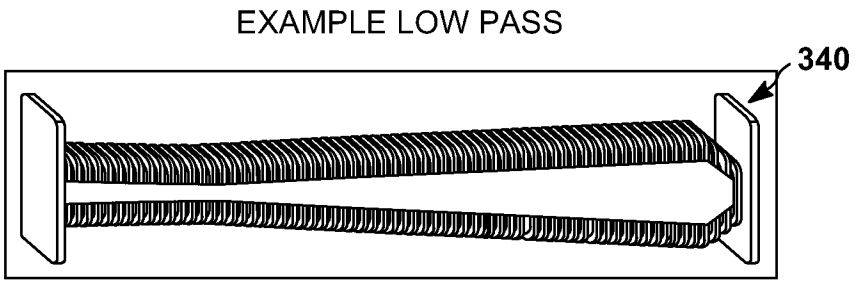
FIG. 3B illustrates an example of a low pass filter configuration that can be configured for an integrated circuit waveguide that employs a tunable material to provide a tunable filter.
Figure 3C:
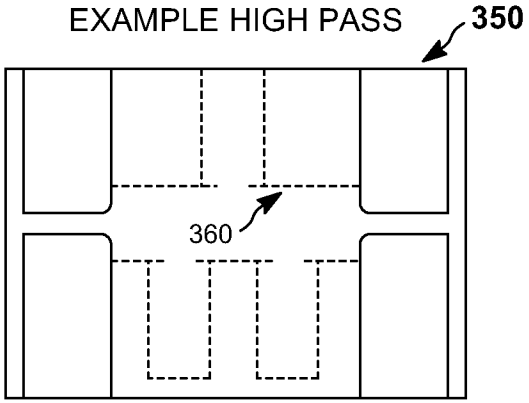
FIG. 3C illustrates an example of a high pass filter configuration that can be configured for an integrated circuit waveguide that employs a tunable material to provide a tunable filter.

FIG. 3B illustrates an example of a low pass filter configuration 340 that can be configured for an integrated circuit waveguide that employs a tunable material to provide a tunable filter. In this example, the low pass filter 340 is provided as an iris-coupled ridged waveguide but other configurations are possible as noted previously. FIG. 3C illustrates an example of a high pass filter configuration 350 that can be configured for an integrated circuit waveguide that employs a tunable material to provide a tunable filter. In this example, a substrate integrated waveguide is provided where couplers 360 between top and bottom planes of the waveguide are configured to provide a high pass filter function.

Figure 4:
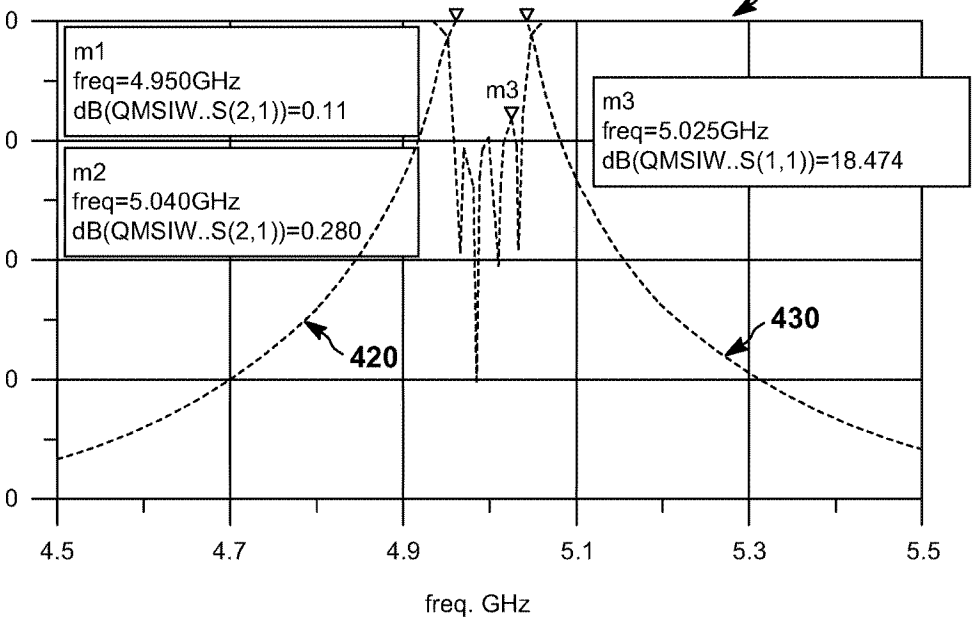
FIG. 4 is an example of a monotonic filter configuration and frequency diagram for an integrated circuit waveguide that employs a tunable material to provide a tunable filter.
Figure 4:
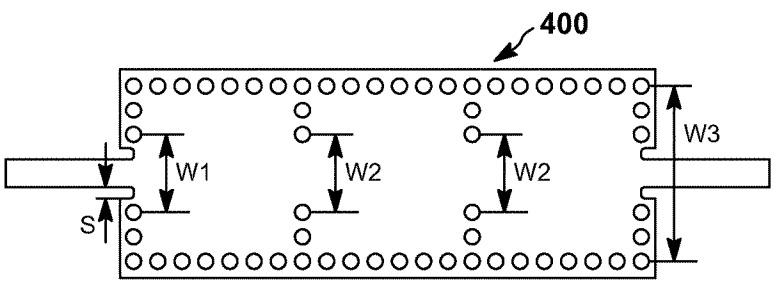

FIG. 4 is an example of a monotonic filter configuration 400 and frequency diagram 410 for an integrated circuit waveguide that employs a tunable material to provide a tunable filter. As shown, rejection skirts at 420 and 430 in the diagram 410 for the monotonic filter 400 exhibit substantially no fly-back (e.g., no harmonic reentry).

Figure 5:
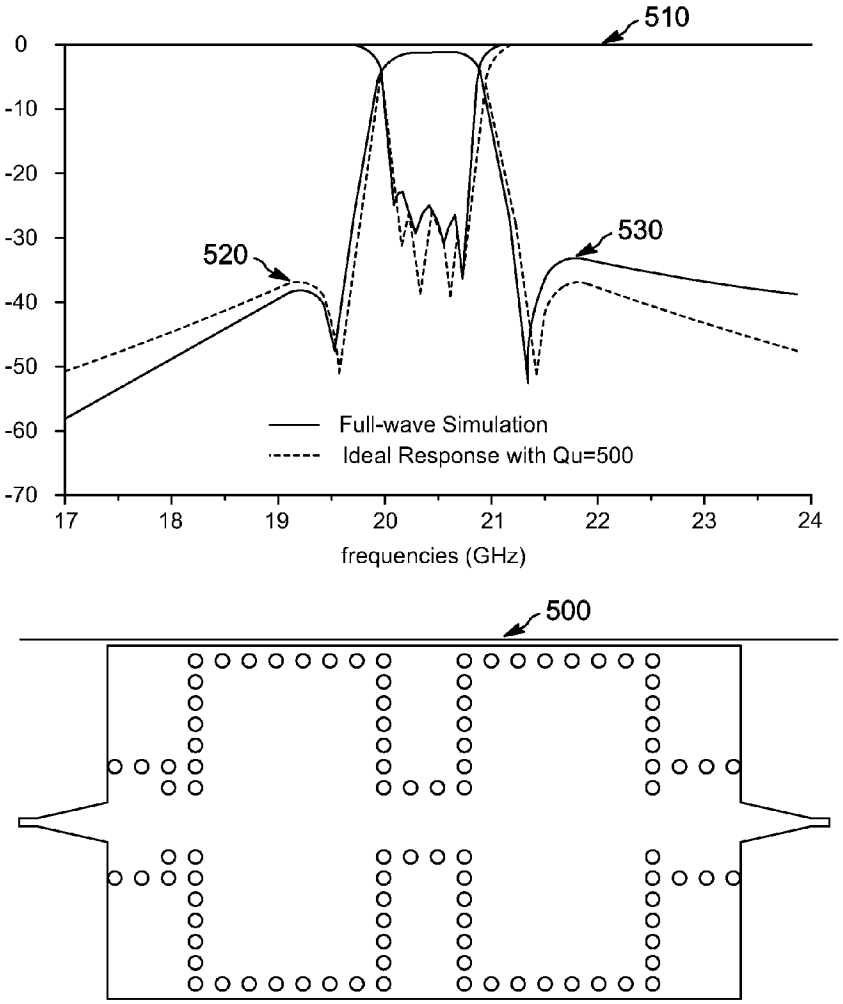
FIG. 5 is an example of an elliptic filter configuration and frequency diagram for an integrated circuit waveguide that employs a tunable material to provide a tunable filter.

FIG. 5 is an example of an elliptic filter configuration 500 and frequency diagram 510 for an integrated circuit waveguide that employs a tunable material to provide a tunable filter. As shown, rejection skirts at 520 and 530 in the diagram 510 for the elliptic filter 500 exhibit fly-back (e.g., harmonic reentry).

Figure 6:
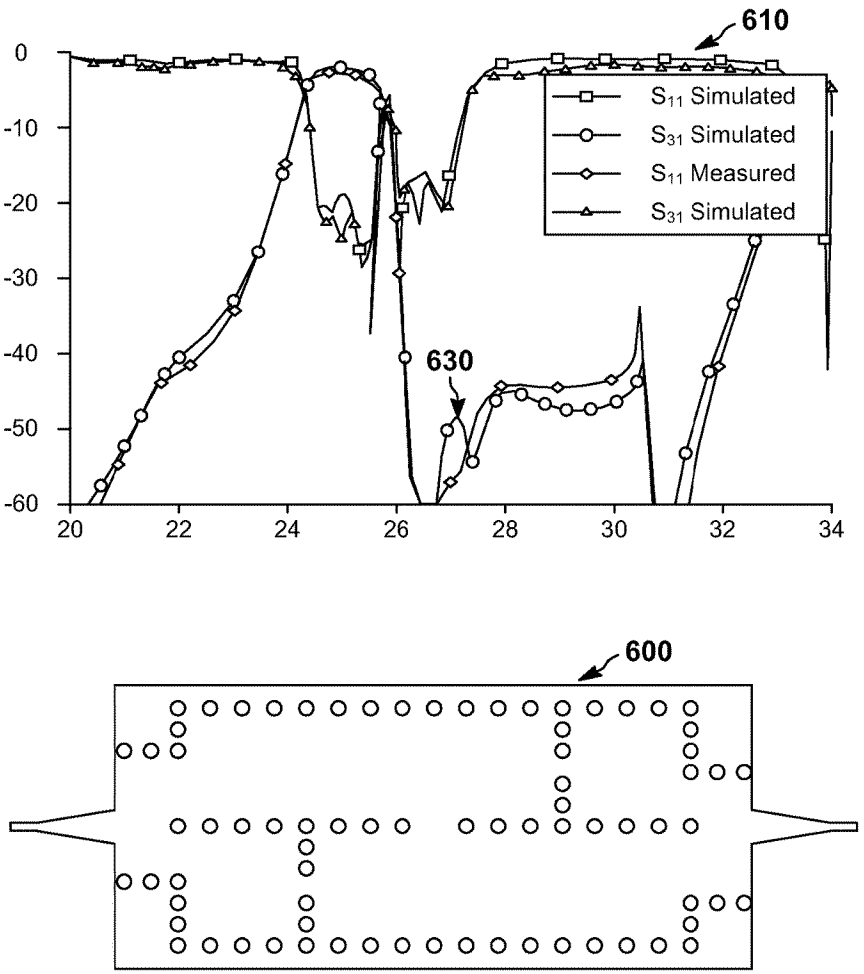
FIG. 6 is an example of a hybrid filter configuration and frequency diagram for an integrated circuit waveguide that employs a tunable material to provide a tunable filter.

FIG. 6 is an example of a hybrid filter configuration 600 and frequency diagram 610 for an integrated circuit waveguide that employs a tunable material to provide a tunable filter. In this example, the hybrid filter 600 exhibits filter zeroes such as shown at 630.

Figure 7:
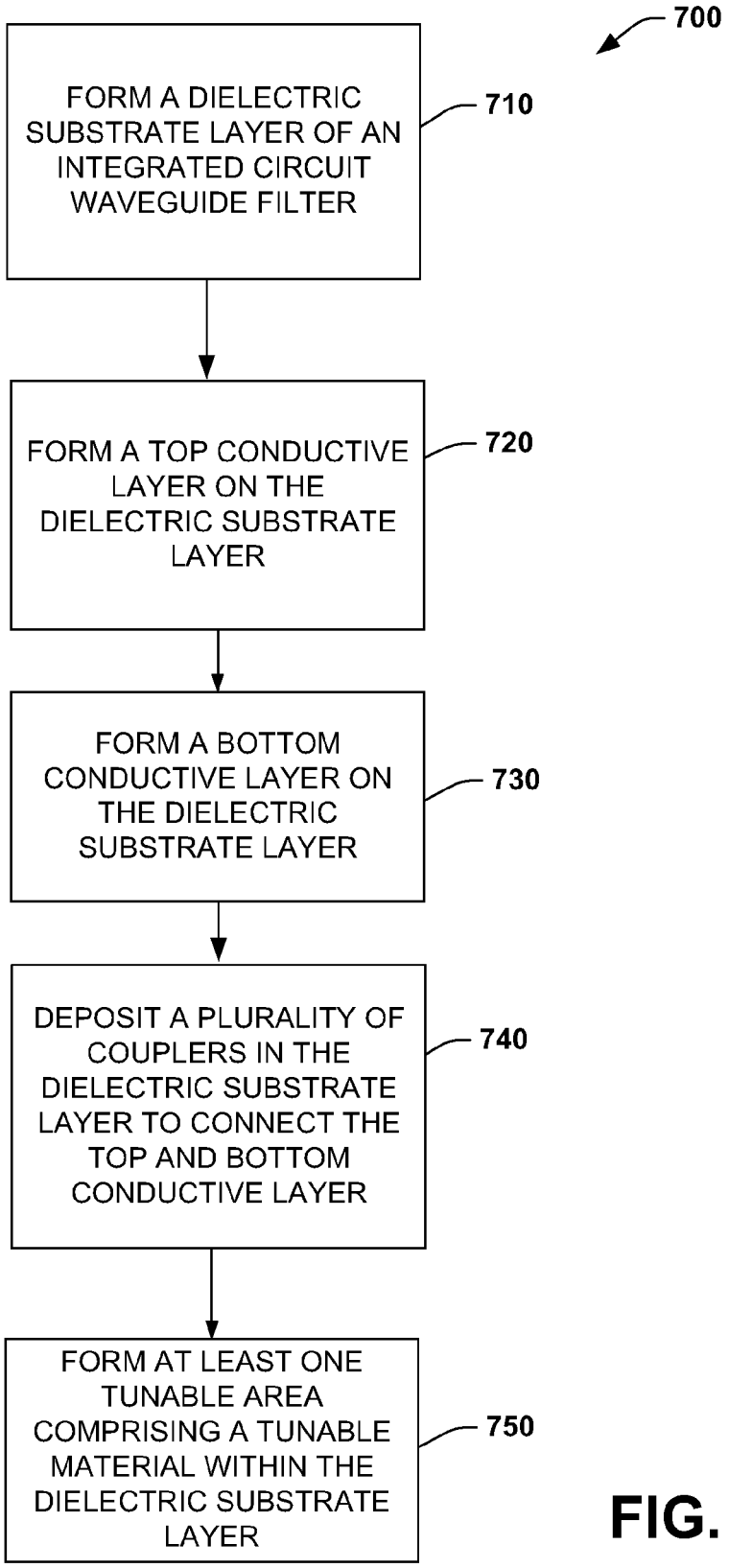
FIG. 7 illustrates an example of a method to fabricate an integrated circuit waveguide that employs a tunable material to provide a tunable filter.

In view of the foregoing structural and functional features described above, an example method will be better appreciated with reference to FIG. 7. While, for purposes of simplicity of explanation, the method is shown and described as executing serially, it is to be understood and appreciated that the method is not limited by the illustrated order, as parts of the method could occur in different orders and/or concurrently from that shown and described herein.

FIG. 7 illustrates an example of a method 700 to fabricate an integrated circuit waveguide that employs a tunable material to provide a tunable filter. At 710, the method 700 includes forming a dielectric substrate layer of an integrated circuit waveguide filter (e.g., layer 150 of FIG. 1B). Such forming can be depositing a silicon layer via chemical vapor deposition, for example. The dielectric substrate layer has a relative permittivity, εr that affects the tuning of the integrated circuit waveguide filter. At 720, the method 700 includes forming a top conductive layer on the dielectric substrate layer of the integrated circuit waveguide filter (e.g., layer 130 of FIG. 1B). This can include a chemical deposition process and include depositing conductive materials such as gold, copper, or silver, for example. At 730, the method 700 includes forming a bottom conductive layer on the dielectric substrate layer of the integrated circuit waveguide filter (e.g., layer 134 of FIG. 1B).

At 740, the method includes depositing a plurality of couplers in the dielectric substrate layer to connect the top conductive layer and the bottom conductive layer (e.g., couplers 140/140*a* of FIGS. 1A/1B). The plurality of couplers form an outline of the waveguide filter and can define its respective filter capabilities. At 740, the method 750 includes forming at least one tunable area comprising a tunable material within the dielectric substrate layer (e.g., tunable vias 160/160*a* of FIGS. 1A/1B). The tunable area can be a via in one example or can be another shape such as a circle, ellipse, or rectangle that substantially fills the area within the outline of the waveguide filter formed by the respective couplers. The tunable area is coupled to a set of electrodes. The set of electrodes enable a voltage to be applied to the tunable material within the tunable area to change the relative permittivity of the dielectric substrate layer and to enable tuning the frequency characteristics of the integrated circuit waveguide filter. Although not shown, the method 700 can include forming the tunable material as BaSrTiO3 (or other materials and/or oxides) where, Ba is Barium, Sr is Strontium, and TiO3 is Titanate comprising Titanium and Oxygen.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus, comprising:

a top conductive layer of an integrated circuit waveguide filter;

a bottom conductive layer of the integrated circuit waveguide filter, the top and bottom conductive layers coupled by a plurality of couplers that form an outline of the waveguide filter;

a dielectric substrate layer disposed between the top conductive layer and the bottom conductive layer of the integrated circuit waveguide filter, the dielectric substrate layer having a relative permittivity, $\varepsilon_r$ that affects tuning of the integrated circuit waveguide filter; and at least one tunable via comprising a tunable material disposed within the dielectric substrate layer, the at least one tunable via coupled to a set of electrodes, the set of electrodes enable a voltage to be applied to the tunable material within the at least one tunable via to change the relative permittivity of the dielectric substrate layer and to enable tuning of frequency characteristics of the integrated circuit waveguide filter.

2. The apparatus of claim 1, wherein the tunable material comprises a chemical composition of $BaSrTiO_3$ where, Ba is Barium, Sr is Strontium, and $TiO_3$ is Titanate comprising Titanium and Oxygen.

3. The apparatus of claim 1, wherein the tunable material comprises a chemical composition of $Ba_xCa_{1-x}TiO_3$, where Ba is Barium, Ca is Calcium, $TiO_3$ is Titanate comprising Titanium and Oxygen, and x is varied in a range from about 0.2 to about 0.8 to facilitate hysteresis stability of the tunable material.

4. The apparatus of claim 1, wherein the tunable material comprises a chemical composition of $Pb_xZr_{1-x}TiO_3$, where Pb is Lead, Zr is Zirconium, and $TiO_3$ is Titanate comprising Titanium and Oxygen, and x is varied in a range from about 0.05 to about 0.4 to facilitate hysteresis stability of the tunable material.

5. The apparatus of claim 1, wherein the tunable material comprises a chemical composition of $(Bi_{3x}, Zn_{2-3x})(Zn_x Nb_{2-x})$ (BZN) where Bi is Bismuth, Zn is Zinc, Nb is Niobium, and x is ½ or ⅔ to facilitate hysteresis stability of the tunable material.

6. The apparatus of claim 1, wherein the tunable material is selected from a chemical composition of at least one of $PbLaZrTiO_3$, $PbTiO_3$, $BaCaZrTiO_3$, $NaNO_3$, $KNbO_3$, $LiNbO_3$, $LiTaTiO_3$, $PbNb_2O_6$, $PbTa_2O_6$, $KSr(NbO_3)$, $NaBa_2(NbO_3)_5$, $KH_2PO_4$, where Pb is Lead, Zr is Zirconium, Ti is Titanium, Ba is Barium, Ca is Calcium, Nb is Niobium, La is Lanthanum, Na is sodium, N is Nitrogen, K is potassium, Li is lithium, Ta is tantalum, H is Hydrogen, P is Phosphorus, Sr is Strontium, O is Oxygen, Pb is Lead, and $TiO_3$ is Titanate comprising Titanium and Oxygen.

7. The apparatus of claim 1, wherein the tunable material includes metal oxides selected from a chemical composition of at least one of Mg, Ca, Sr, Ba, Be, Ra, Li, Na, K, Rb, Cs, Fr, Ti, V, Cr, Mn, Zr, Nb, Mo, Hf, Ta, and W, where Mg is Magnesium, Ca is Calcium, Sr is Strontium, Ba is Barium, Be is Beryllium, Ra is Radium, Li is lithium, Na is sodium, K is Potassium, Rb is Rubidium, Cs is Cesium, Fr is Francium, Ti is Titanium, V is Vanadium, Cr is Chromium, Mn is Manganese, Zr is Zirconium, Nb is Niobium, Mo is Molybdenum, Hf is Hafnium, Ta is tantalum, and W is Tungsten.

8. The apparatus of claim 7, wherein the tunable material includes metal oxides selected from a chemical composition of at least one of Al, Si, Sn, Pb, Bi, Sc, Y, La, Ce, Pr, and Nd, where Al is Aluminum, Si is Silicon, Sn is Tin, PB is Lead, Bi is Bismuth, Sc is Scandium, Y is Yttrium, La is Lanthanum, Ce is Cerium, Pr is Praseodymium, and Nd is Neodymium.

9. The apparatus of claim 8, wherein the tunable material includes metal oxides selected from a chemical composition of at least one of $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$, and $La_2O_3$.

10. The apparatus of claim 1, wherein the plurality of couplers are conductive vias as a low pass filter waveguide, a high pass filter waveguide, a band pass filter waveguide, or a band reject filter waveguide.

11. The apparatus of claim 1, wherein the plurality of couplers are waveform shaping that includes at least one of a monotonic filter, an elliptic filter, and a hybrid filter.

12. A circuit, comprising:

at least two segments of an integrated circuit waveguide filter, the at least two segments coupled by an iris;

each segment of the integrated circuit waveguide filter further comprises:

a top conductive layer, a bottom conductive layer, the top and bottom conductive layers coupled by a plurality of couplers that form an outline of the integrated circuit waveguide filer, a dielectric substrate layer disposed between the top conductive layer and the bottom conductive layer, the dielectric substrate layer having a relative permittivity, $\varepsilon_r$ that affects tuning of the integrated circuit waveguide filter, at least one substrate tunable via comprising a tunable material disposed within the dielectric substrate layer, the at least one substrate tunable via coupled to a set of electrodes, the set of electrodes enable a voltage to be applied to the tunable material within the at least one substrate tunable via to change the relative permittivity of the dielectric substrate layer and to enable tuning of frequency characteristics of the integrated circuit waveguide filter; and at least one iris tunable via comprising the tunable material disposed within the iris coupling the at least two segments, the at least one iris tunable via coupled to the set of electrodes, the set of electrodes enable a second voltage to be applied to the tunable material within the at least one iris tunable via to change a relative permittivity of the iris and to enable the tuning of the frequency characteristics of the integrated circuit waveguide filter.

13. The circuit of claim 12, wherein the plurality of couplers of the at least two segments are conductive vias that form a low pass filter waveguide, a high pass filter waveguide, a band pass filter waveguide, or a band reject filter waveguide.

14. The circuit of claim 12, wherein the plurality of couplers to provide waveform shaping that includes at least one of a monotonic filter, an elliptic filter, and a hybrid filter.

15. The circuit of claim 12, wherein the tunable material of the at least one substrate tunable via or the at least one iris tunable via comprises a chemical composition of $BaSrTiO_3$ where, Ba is Barium, Sr is Strontium, and $TiO_3$ is Titanate comprising Titanium and Oxygen.

16. The circuit of claim 12, wherein the tunable material of at least one of the at least one substrate tunable via and the at least one iris tunable via comprises a chemical composition of $Ba_xCa_{1-x}TiO_3$, where Ca is Calcium and x is varied in a range from about 0.2 to about 0.8 to facilitate hysteresis stability of the tunable material.

17. The circuit of claim 12, wherein the tunable material of the at least one substrate tunable via or the at least one iris tunable via comprises a chemical composition of $Pb_xZr_{1-x}TiO_3$, where Pb is Lead, Zr is Zirconium, and x is varied in a range from about 0.05 to about 0.4 to facilitate hysteresis stability of the tunable material.

18. The circuit of claim 12, wherein the tunable material of the at least one substrate tunable via or the at least one iris tunable via comprises a chemical composition of $(Bi_{3x}, Zn_{2-3x})(Zn_xNb_{2-x})$ (BZN) where Bi is Bismuth, Zn is Zinc, Nb is Niobium, and x is ½ or ⅔ to facilitate hysteresis stability of the tunable material.

19. A method, comprising:

forming a dielectric substrate layer of an integrated circuit waveguide filter, the dielectric substrate layer having a relative permittivity, $\varepsilon_r$ that affects tuning of the integrated circuit waveguide filter;

forming a top conductive layer on the dielectric substrate layer of the integrated circuit waveguide filter;

forming a bottom conductive layer on the dielectric substrate layer of the integrated circuit waveguide filter;

depositing a plurality of couplers in the dielectric substrate layer to connect the top conductive layer and the bottom conductive layer, the plurality of couplers form an outline of the integrated circuit waveguide filter; and forming at least one area comprising a tunable material within at least one tunable via within the dielectric substrate layer, the at least one tunable via coupled to a set of electrodes, the set of electrodes enable a voltage to be applied to the tunable material within the at least one tunable via to change the relative permittivity of the dielectric substrate layer and to enable tuning of frequency characteristics of the integrated circuit waveguide filter.

20. The method of claim 19, wherein the tunable material as $BaSrTiO_3$ where, Ba is Barium, Sr is Strontium, and $TiO_3$ is Titanate comprising Titanium and Oxygen.

* * * * *